US006814367B2

(12) United States Patent
Mercier et al.

(10) Patent No.: US 6,814,367 B2
(45) Date of Patent: Nov. 9, 2004

(54) INTERFACE PLATE INTENDED TO BE SECURED TO THE UPPER FACE OF A SKI

(75) Inventors: Michel Mercier, Voiron (FR); Jean-Marc Hillairet, Nevers (FR); Frédéric Chonier, Cusset (FR)

(73) Assignee: Skis Rossignol S.A., Voiron (FR)

( * ) Notice: Subject to any disclaimer, the term of this patent is extended or adjusted under 35 U.S.C. 154(b) by 11 days.

(21) Appl. No.: 10/061,611

(22) Filed: Feb. 1, 2002

(65) Prior Publication Data

US 2002/0105167 A1 Aug. 8, 2002

(30) Foreign Application Priority Data

Feb. 2, 2001 (FR) ..... 01 01402

(51) Int. Cl.[7] ..... A63C 9/00
(52) U.S. Cl. ..... 280/613; 280/617; 280/633
(58) Field of Search ..... 280/613, 616, 280/617, 618, 607, 609, 625, 627, 14.22, 14.24, 11.3, 633, 14.27; 441/70

(56) References Cited

U.S. PATENT DOCUMENTS

| | | | | | |
|---|---|---|---|---|---|
| 3,785,666 | A | * | 1/1974 | Pierre et al. | 280/633 |
| 4,008,901 | A | * | 2/1977 | Conn | 280/7.13 |
| 4,131,963 | A | * | 1/1979 | Johnson | 441/70 |
| 4,162,089 | A | * | 7/1979 | Alber | 280/618 |
| 4,279,048 | A | * | 7/1981 | Bundschuh et al. | 441/70 |
| 4,290,213 | A | * | 9/1981 | Salomon | 280/613 |
| 4,499,674 | A | * | 2/1985 | Olivieri | 36/117.3 |
| 4,519,625 | A | * | 5/1985 | Luitz et al. | 280/633 |
| 4,758,192 | A | * | 7/1988 | Marks | 441/70 |
| 4,891,027 | A | * | 1/1990 | Plunkett | 441/70 |
| 5,035,443 | A | * | 7/1991 | Kincheloe | 280/618 |
| 5,143,395 | A | * | 9/1992 | Mayr | 280/602 |
| 5,480,175 | A | * | 1/1996 | Astier et al. | 280/607 |
| 5,505,478 | A | * | 4/1996 | Napoliello | 280/618 |
| 5,957,478 | A | * | 9/1999 | Vigny | 280/615 |
| 6,007,086 | A | * | 12/1999 | Hopkins | 280/612 |
| 6,010,138 | A | * | 1/2000 | Bobrowicz et al. | 280/11.36 |
| 6,065,895 | A | * | 5/2000 | Lehner et al. | 403/105 |
| 6,102,425 | A | * | 8/2000 | Gotzfried | 280/602 |
| 6,196,559 | B1 | * | 3/2001 | Cress | 280/14.22 |
| 6,557,866 | B2 | * | 5/2003 | Jones et al. | 280/14.22 |
| 6,631,918 | B2 | * | 10/2003 | Silva | 280/607 |

FOREIGN PATENT DOCUMENTS

| | | |
|---|---|---|
| AT | 393 968 B | 1/1992 |
| EP | 0346 414 B1 | 11/1988 |
| FR | 2128919 | 10/1972 |
| FR | 2 635 465 | 2/1990 |
| FR | 2772286 | 6/1999 |
| FR | 2772626 | 6/1999 |

* cited by examiner

*Primary Examiner*—Christopher P. Ellis
*Assistant Examiner*—Kelly E Campbell
(74) *Attorney, Agent, or Firm*—Heslin Rothenberg Farley & Mesiti P.C.; Victor A. Cardona, Esq.

(57) ABSTRACT

Interface plate (1) intended to be secured to the upper face of a ski and capable of accommodating the toe piece and the heel piece of a safety binding, characterized in that it has a longitudinal recess forming a slideway capable of holding projecting parts situated under the toe piece and under the heel piece, while allowing the toe piece and the heel piece to slide inside the slideway with a view to adjusting the binding to the length of the boot, and in which the profiles (10, 11; 12, 13) of the zones of the slideway respectively holding the toe piece and the heel piece are geometrically identical.

23 Claims, 2 Drawing Sheets

INTERFACE PLATE INTENDED TO BE SECURED TO THE UPPER FACE OF A SKI

This application claims the priority of French application FR/01.01402, filed Feb. 2, 2001, the entire disclosure of which is incorporated herein by reference.

TECHNICAL FIELD

The invention pertains to the field of gliding sports and, more particularly, to that of Alpine skiing. It concerns more specifically an accessory component which allows the binding to be fitted and adjusted easily on a ski. It relates more precisely to an interface plate which is intended to be secured to the upper face of a ski.

PRIOR ART

In general, a ski binding is composed of a toe piece and a heel piece. Traditionally, the toe piece and the heel piece rest directly on the upper face of the ski, onto which they are screwed.

Numerous devices have already been proposed so that the toe piece and the heel piece are not screwed directly onto the upper face of the ski, but instead are secured to the latter via additional components.

For instance, the document FR 2 128 919 describes a ski on which a first plate is fitted, the side edges of which plate are profiled to form two slideways. This first plate accommodates a second plate, which consequently has a capacity for longitudinal sliding. The toe piece and the heel piece are fitted on the second plate in such a way that it is possible to move both the toe piece and the heel piece relative to the ski, so as to adjust the mid-point of the boot, i.e. so that the riddle of the boot can be positioned at various points over the length of the ski while maintaining a constant toe-piece/heel-piece separation. The adjustment of the toe piece and the heel piece, with a view to adapting to the size of the boot, is carried out as on a traditional ski, by acting on the toe piece and/or the heel piece.

Furthermore, the document EP 0 346 414 describes another improved binding device. The device for fitting the binding comprises two lateral rails which are secured to the ski. These two lateral rails are in the form of a slideway and receive two connecting rods which can adopt several different positions with respect to the lateral rails, by sliding between the latter. The toe piece and the heel piece of the binding are fitted on these connecting rods. By temporarily disconnecting the connecting rods and the slideways, the toe piece and the heel piece can be moved simultaneously in order to adjust the position of the middle of the boot relative to the ski.

The adjustment of the position of the toe piece and the heel piece, with a view to adapting to the length of the boot, is carried by acting on some adjustment screws. In this way, the position of the toe piece and/or of the heel piece is adjusted relative to the connecting rods, and hence relative to the ski.

It will be understood that this adjustment device is relatively complex since it requires many components, which reduces the reliability of the system and increases its cost price.

Furthermore, in the case of the two particular devices mentioned above, as well as in the case of traditional fitting, the screws for fitting the binding either on an intermediate device or directly on the ski occupy lateral space relative to the toe piece and the heel piece. The need for this lateral space imposes constraints on the geometry of the toe piece and of the heel piece.

It is an object of the invention to provide a system which allows simple adjustment of the positions of the toe piece and of the heel piece in order to adapt to different boot sizes with the fewest possible mechanical pieces.

It is also an object of the invention to permit straightforward replacement of a part of the binding, i.e. the toe piece or the heel piece, that is to say without the need to re-drill the plate or any intermediate component.

DESCRIPTION OF THE INVENTION

The invention therefore relates to an interface plate which is intended to be secured to the upper face of a ski. This interface plate is capable of accommodating the toe piece and the heel piece of the safety binding.

According to the invention, this plate is characterized in that it has a longitudinal recess forming a slideway capable of holding projecting parts situated under the toe piece and under the heel piece, while allowing the toe piece and the heel piece to slide inside the slideway with a view to adjusting the binding to the length of the boot.

The profiles of the zones of the slideway respectively holding the projecting parts situated under the toe piece and the heel piece are geometrically identical.

In other words, the plate according to the invention is fixed onto the ski by connecting screws, or any other equivalent means, which are located in a unique position, irrespective of the adjustment position of the toe piece and of the heel piece. The interaction between the plate and the toe piece and the heel piece takes place inside a slideway which has the same profile over its entire functional length, i.e. at least in the zones in which it holds the protruding parts situated under the toe piece and the heel piece.

Hence, in order to adjust the binding to the length of the boot, it is sufficient to modify either the position of the toe piece or that of the heel piece, by making them slide in the characteristic slideway.

By virtue of this geometry, the toe piece and the heel piece can occupy a larger part of the length of the board, since no screw is necessary for immobilizing the position of the toe piece and of the heel piece relative to the slideway. Better guiding of the ski is hence obtained.

Furthermore, since the slideway is integrated into the plate, the total height of the plate/toe-piece or plate/heel-piece assembly is reduced compared with the prior art.

The characteristic plate of the invention can be used in various ways. For instance, this interface plate may have its lower face coming directly into contact over its major part with the upper face of the ski. This case may involve a simple metal sheet which is fixed onto the ski during the manufacture of the latter.

In a second example, the characteristic plate may form an elevation platform separating the toe piece and the heel piece by several millimeters from the upper face of the ski. In other words, the elevation platform incorporates the slideway for adjusting the toe piece and the heel piece.

In one particular form, the interface plate forming an elevation platform may have lateral portions directed downwards and intended to interact with the ski.

According to one characteristic of the invention, the slideway may include at least one region located in the zone accommodating the toe piece or the heel piece, the said region forming a rack with which means for longitudinally adjusting the toe piece or the heel piece interact.

Advantageously, in practice, the plate includes at least one cavity accommodating a panel supporting the rack. In other words, the bottom of the slideway has a recess containing a notched zone, or rack, Interacting with a worm screw situated in the toe piece or the heel piece. In this way, by acting on this worm screw, or on an equivalent means, the toe piece and the heel piece can be moved slightly inside the slideway with a view to adjusting their positions.

The racks may also be produced directly in the bottom of the slideway, by machining or the like.

The interface plate according to the invention can adopt various geometries. For instance, in a first variant, the plate extends continuously between the zones receiving the toe piece and the heel piece, which makes it possible to obtain by design a slideway which has an identical geometrical profile between the toe-piece zone and the heel-piece zone. It may for example be obtained by extrusion, or it may be produced from a profiled metal section, or it may alternatively be moulded.

In an alternative version, the slideway may be interrupted in the central area of the plate, so that the latter includes two slideways which have the same geometrical profiles and are arranged in alignment with one another. In this case, the central zone of the plate, extending on either side of the middle of the boot, does not have the means for holding the protruding parts situated under the toe piece and the heel piece.

In another alternative embodiment, the characteristic plate may be formed by two individual plates respectively accommodating the toe piece and the heel piece, these individual plates being joined by a connecting portion. In other words, the central part of the interface plate, which does not accommodate either the toe piece or the heel piece, consists of an additional component which does not include the slideway but which provides connection between the front individual plate and the rear individual plate, each of which include slideways having identical geometrical profiles.

In a particular embodiment, the slideway has a profile including a flat bottom and two lateral zones forming a lip returning in the direction of the longitudinal mid-plane of the interface plate. In this way, the geometrical profile of the slideway makes it possible to restrain the protruding parts situated under the toe piece and the heel piece, which have an overall inverted-T profile. The ends of the horizontal branch of the T are then restrained by the lips of the lateral zones of the slideway.

In a more improved form of the invention, the toe-piece/heel-piece and interface-plate assembly also comprises means for moving the toe piece and the heel piece simultaneously and in the opposite direction when the binding is being adjusted to the length of the boot.

In other words, when acting on the toe piece or the heel piece in order to move it, the opposite movement of the heel piece or the toe piece is automatically induced, so that the toe piece and the heel piece move away from or towards one another.

These two elements therefore move symmetrically about the mid-point of the boot.

BRIEF DESCRIPTION OF THE FIGURES

The way in which the invention is embodied, as well as the advantages which result therefrom, will become readily apparent from the description of the following embodiments, with the aid of the appended figures, in which.

EMBODIMENTS OF THE INVENTION

Figure 1:
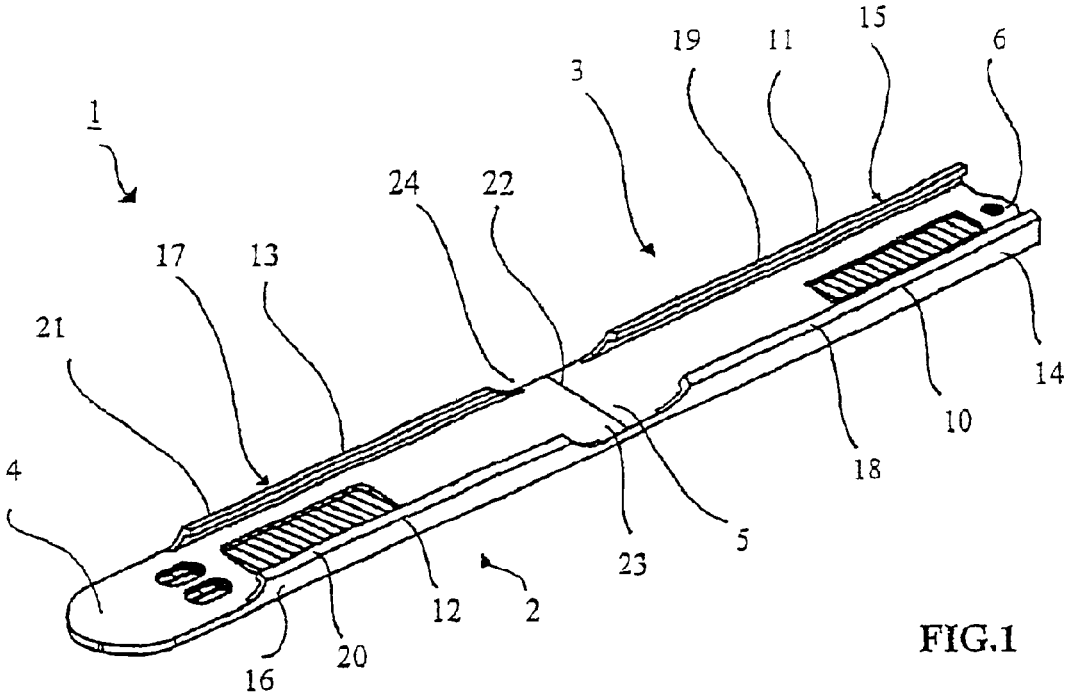
FIG. 1 is an outline perspective view of an interface plate according to the invention.
Figure 2:
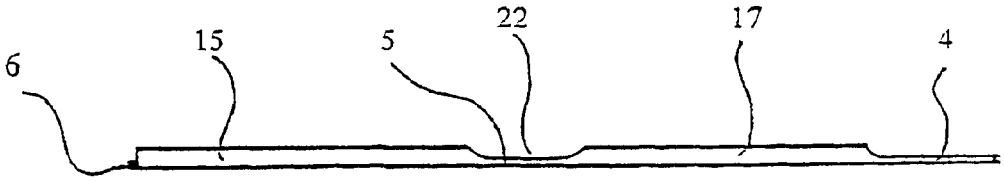
FIG. 2 is a side view of the plate in FIG. 1.
Figure 3:
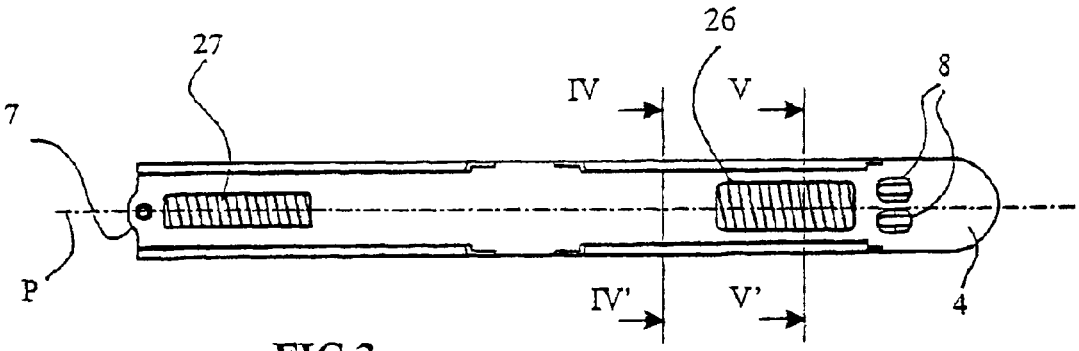
FIG. 3 is a plan view of the plate in FIG. 1.

As already mentioned, the invention relates to an interface plate intended to be fitted on an Alpine ski with a view to accommodating the toe piece and the heel piece of safety bindings.

The figure illustrates such a plate (1), in which a front zone (2) intended to accommodate the toe piece of the binding, and a rear zone (3) intended to accommodate the heel piece of the binding, can be seen. More precisely, and in the form which is illustrated, this plate (1) includes a flat bottom (5) which extends from the front end (4) of the plate to the rear end (6). In the rear area, this flat bottom (5) has a passage (7) through which a screw for securing it to the board can pass.

On the opposite side, close to the front end (4), the flat bottom (5) has two through-openings (8) allowing the front part of the plate to be secured to the board. These through-openings (8) have an elongate shape so that the front end (4) of the board can slide slightly relative to the board. Nevertheless, the invention is by no means limited to any particular form of the means for securing the plate relative to the board. In particular, it encompasses all variants which may or may not permit slight sliding of a front, central or rear part of the plate.

According to the invention, the bottom (5) of the plate has, on each side, lateral zones (10, 11, 12, 13) which rise upwards. More precisely, each of these lateral zones (10–13) has a portion (14–17) which is perpendicular to the bottom (5) of the plate, and a portion (18–21) which is parallel to the bottom (5) of the plate and is directed towards the longitudinal mid-plane (P). These portions (18–21) hence constitute lips which close the slideways proper. The purpose of these slideways is to restrain the toe piece and the heel piece laterally and vertically.

In the form illustrated in FIG. 1, these slideways are interrupted in the central zone of the platform, close to the mark (22) for the middle of the boot. The lateral portions (15, 17, 14, 16) are separated by a notch (23, 24) in which the plate only includes its bottom (5). This notch (23, 24) permits slight longitudinal bending of the plate.

It should be noted that the lateral portions (10, 11) situated in the rear part (3) of the plate have an identical shape to the lateral portions (12, 13) present in the front part (2) of the plate. The two slideways defined in this way have an identical geometrical profile.

According to another characteristic of the invention, the bottom (5) of the plate has two recesses (26, 27) formed substantially along the longitudinal mid-plane (P) of the plate. These recesses (26, 27) are of rectangular overall shape, and they are located respectively in the front (2) and rear zones of the plate. These recesses (26, 27) form a reduced-thickness zone of the bottom (5) of the plate. These recesses (26, 27) receive panels supporting racks (28) intended to interact with the components for adjusting the longitudinal position of the toe piece and of the heel piece.

In the case (not shown) in which the bottom (5) of the plate rests directly on the upper face of the ski, these recesses (26, 27) may be open so that the racks which they receive rest directly on the upper face of the ski.

It is also possible to adopt other geometries, in which these recesses are partially open and have shoulders intended to support the characteristic racks.

In practice, these racks (28, 29) are engaged by worm screws capable of pivoting inside the toe piece and the heel piece when the latter are being adjusted. The worm screws may be replaced by locking bars.

Figure 4:
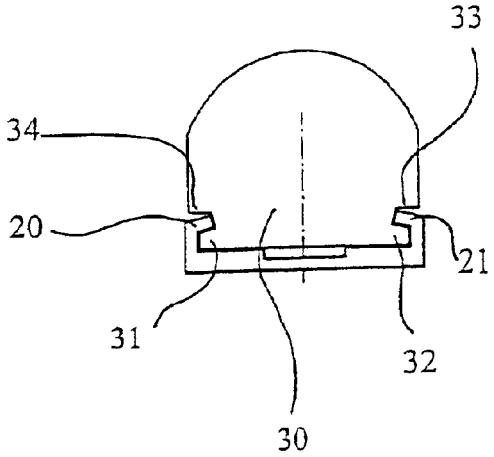
FIG. 4 is a view in section on the plane IV-IV' or the plate according to the invention, equipped with a toe piece.
Figure 5:
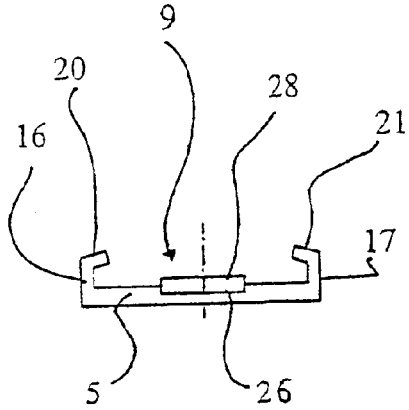
FIG. 5 is a view in section on the plane V-V' of FIG. 3.

As illustrated in FIG. 4, the toe piece has, in its lower part, a protruding zone (30) which has an overall inverted-T shape. More precisely, this protrusion (30) has two lateral projections (31, 32) which are accommodated under the portions (20, 21) of the lateral zones (12, 13) of the slideway of the front part (2) of the plate.

The toe piece also has zones (33, 34) extending widthwise above the slideway portions (20, 21). The penetration of the portions (20, 21) inside the shape of the toe piece ensures accurate and efficient lateral restraining of the toe piece in the slideway.

A shape identical to the protrusion (30) is present under the heel piece (not shown).

Figure 6:
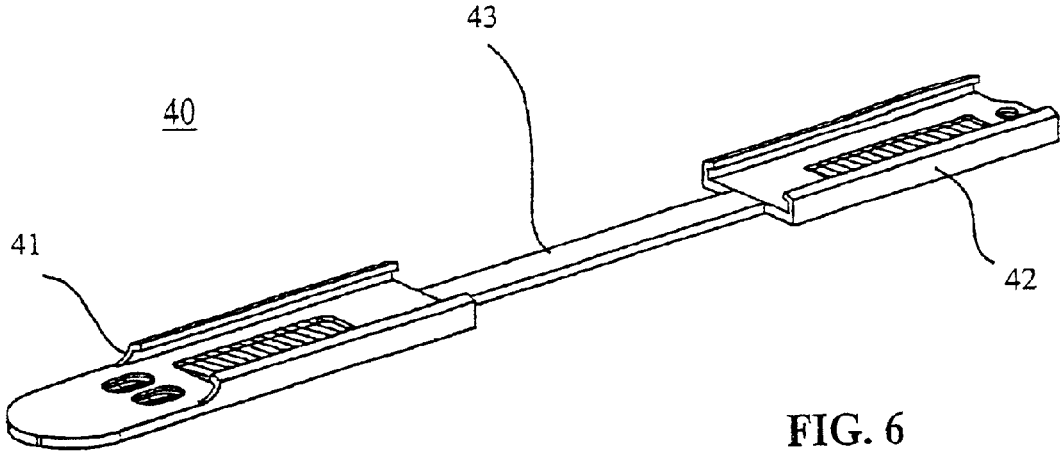
FIG. 6 is an outline perspective view of a plate produced according to an alternative embodiment.

In the variant illustrated in FIG. 6, the interface plate (40) consists of two individual plates (41, 42) separated by a connecting portion (43). This connecting portion (43) may be rigid or flexible, and it may optionally contain a connecting member which makes it possible to induce a movement of the heel piece when the position of the toe piece is being adjusted, or vice versa.

By way of example (not shown), this may involve a double worm screw with opposite screw threads. In this case, the lower zone of the protrusion (30) of the toe piece includes a rack engaging one of the screw threads of the double worm screw. When the toe piece is being moved in the slideway, it causes the double worm screw to rotate. This rotational motion then moves the heel piece, which is itself equipped with a rack likewise engaged on the other screw thread of the double worm screw.

In this way, the toe piece is also moved when the heel piece is being moved, or vice versa. The toe piece and the heel piece move symmetrically towards or away from the position of the middle of the boot, which avoids any front or rear offset of the actual position of the middle of the boot relative to its optimum position.

The above description demonstrates that the interface plate according to the invention has many advantages, in particular that it is very easy to fit on the ski, and that it is easy to operate in order to adjust the binding relative to the length of the boot.

What is claimed is:

1. An interface plate configured to be secured to the upper face of a ski and to receive a toe piece and a heel piece of a safety binding, wherein said interface plate comprises:

a longitudinal recess forming a slideway, the toe piece comprising a lower part having a first projecting part and the heel piece comprising a lower part having a second projecting part, said slideway configured to engage the first projecting part and the second projecting part to allow the first projecting part and the second projecting part to slide inside the slideway and to retain the toe piece and the heel piece in the slideway to allow the binding to be adjusted to a length of a boot, and wherein profiles of zones of the slideway respectively holding the first projecting part and the second projecting part are substantially geometrically identical;

a second recess comprising means for longitudinally adjusting at least one of the toe piece and the heel piece from a first position to a second position to adjust the binding to the length of the boot; and the means for adjusting comprising means for incrementally adjusting the at least one of the toe piece and the heel piece.

2. Interface plate according to claim 1 further comprising a lower face configured to directly contact the upper face of the ski.

3. Interface plate according to claim 1 further comprising on elevation platform separating the toe piece and the heel piece by several millimeters from the upper face of the ski.

4. Interface plate according to claim 1, wherein the slideway includes at least one region located in a zone (2, 3) accommodating the toe piece or the heel piece, said region forming a rack (28) with which means for longitudinally adjusting the toe piece or the heel piece interact.

5. Interface plate according to claim 4, further comprising at least one cavity (26, 27) accommodating a panel supporting the rack (28).

6. Interface plate according to claim 5, wherein said plate is formed from a profiled metal section.

7. Interface plate according to claim 5, wherein said plate is obtained by moulding.

8. Interface plate according to claim 1, wherein said plate extends continuously between the zone receiving the toe piece and the zone receiving the heel piece.

9. Interface plate according to claim 1, wherein the slideway is interrupted in a central area of the plate, so that the plate includes two slideways which have a same geometrical profile and are arranged in alignment with one another.

10. Interface plate according to claim 1, wherein said plate is formed by two individual plates (41, 42) respectively accommodating the toe piece and the heel piece, said individual plates (41, 42) being joined by a connecting portion (43).

11. Interface plate according to claim 1, wherein the slideway has a profile including a flat bottom (5) and two lateral zones (10–13) forming a lip (18–21) returning in the direction of the longitudinal mid-plane (P) of the plate.

12. Assembly comprising a toe piece, a heel piece and an interface plate according to claim 1 wherein said assembly comprises means for moving the toe piece and the heel piece simultaneously and in an opposite direction relative to each other when the binding is being adjusted to the length of the boot.

13. Assembly according to claim 1, wherein the toe piece and the heel piece comprise geometrically identical projecting parts having an inverted-T profile.

14. An interface plate configured to be secured to the upper face of a ski and to receive a toe piece and a heel piece of a safety binding, wherein said interface plate comprises a longitudinal recess forming a slideway, the toe piece comprising a lower part having a first projecting part and the heel piece comprising a lower part having a second projecting part, said slideway configured to engage the first projecting part and the second projecting part to allow the first projecting part and the second projecting part to slide inside said slideway and to releasably attach the toe piece and the heel piece to the slideway to adjust the binding to a length of a boot, and wherein profiles of zones of the slideway respectively holding the first projecting part and the second projecting part are substantially geometrically identical; and the slideway having a slideway recess, the slideway recess having means for selectively and longitudinally adjusting at least one of the toe piece and the heel piece to adjust the binding to the length of the boot.

15. The plate of claim 14 wherein the means for adjusting comprises means for moving the toe piece and the heel piece simultaneously and in an opposite direction relative to each other when the binding is being adjusted to the length of the boot.

16. An interface plate configured to be secured to the upper face of a ski and to receive a toe piece and a heel piece of a safety binding, wherein said interface plate comprises:

at least one lateral zone configured to restrain at least one of the toe piece and the heel piece laterally and vertically;

the toe piece comprising a lower part having a first projecting part and the heel piece comprising a lower part having a second projecting part, said at least one lateral zone configured to engage at least one of the first projecting part and the second projecting part to allow the at least one of the first projecting part and the second projecting part to slide inside said at least one lateral zone and to adjust the binding to a length of a boot, and wherein profiles of zones of said at least one lateral zone configured to engage the at least one first projecting part and the second projecting part are substantially geometrically identical; and a recess having means for longitudinally adjusting at least one of the toe piece and the heel piece from a first position to a second position to adjust the binding to the length of the boot.

17. The plate of claim 16 wherein the means for adjusting comprises means for continuously adjusting the at least one of the toe piece and the heel piece.

18. The plate of claim 16 wherein the means for adjusting comprises means for incrementally adjusting the at least one of the toe piece and the heel piece.

19. The plate of claim 16 wherein the means for adjusting comprises means for moving the toe piece and the heel piece simultaneously and in an opposite direction relative to each other when the binding is being adjusted in the length of the boot.

20. The plate of claim 16 wherein said means for adjusting is located in said recess.

21. The plate of claim 16 further comprising an upper surface for receiving the toe piece and the heel piece, said upper surface having a longitudinally continuous height.

22. The plate of claim 21 wherein said upper surface is substantially equidistant from a top surface of the ski.

23. An interface plate configured to be secured to the upper face of a ski and to receive a toe piece and a heel piece of a safety binding, wherein said interface plate comprises:

a longitudinal recess forming a slideway, the toe piece comprising a lower part having a first projecting part and the heel piece comprising a lower part having a second projecting part, said slideway configured to engage the first projecting part and the second projecting part to allow the first projecting part and the second projecting part to slide inside the slideway and to retain the toe piece and the heel piece in the slideway to allow the binding to be adjusted to a length of a boot, and wherein profiles of zones of the slideway respectively holding the first projecting part and the second projecting part are substantially geometrically identical;

a second recess comprising means for longitudinally adjusting at least one of the toe piece and the heel piece from a first position to a second position to adjust the binding to the length of the boot; and the means for adjusting comprising means for selectively adjusting the at least one of the toe piece and the heel piece.

* * * * *